United States Patent [19]

Kalinowski et al.

[11] 4,423,108

[45] Dec. 27, 1983

[54] METHOD FOR DURABLE PRESS FINISH USING FORMALDEHYDE-FREE ORGANOSILICON COMPOSITIONS AND TEXTILE THEREFROM

[75] Inventors: Robert E. Kalinowski, Auburn; Gary A. Vincent, Midland, both of Mich.

[73] Assignee: Dow Corning Corporation, Midland, Mich.

[21] Appl. No.: 360,137

[22] Filed: Mar. 22, 1982

[51] Int. Cl.[3] ..... D06M 13/18; D06M 15/30

[52] U.S. Cl. ..... 428/266; 8/115.7; 8/120; 427/387; 428/274; 428/290

[58] Field of Search ..... 8/120, 115.7; 428/266, 428/274, 290; 427/387

[56] References Cited

U.S. PATENT DOCUMENTS

| | | | |
|---|---|---|---|
| 3,668,001 | 6/1972 | Hosokawa et al. | 117/139.4 |
| 4,167,501 | 9/1979 | Rooks | 260/29.4 R |
| 4,269,603 | 5/1981 | Worth | 8/116.4 |

FOREIGN PATENT DOCUMENTS 2922376 4/1980 Fed. Rep. of Germany .

*Primary Examiner*—James C. Cannon
*Attorney, Agent, or Firm*—George A. Grindahl

[57] ABSTRACT

This disclosure relates to a method for imparting durable press characteristics to textile fabrics containing cellulosic fibers. The fabric is impregnated with a homogeneous composition comprising a volatile liquid carrier and certain methoxylated, phenyl-substituted fluid organosilicon polymers, and is subsequently heated to effect crosslinking of the fluid organosilicon polymers.

10 Claims, No Drawings

METHOD FOR DURABLE PRESS FINISH USING FORMALDEHYDE-FREE ORGANOSILICON COMPOSITIONS AND TEXTILE THEREFROM

BACKGROUND OF THE INVENTION

The present invention relates to a method for treating cellulosic fiber-containing textiles with an organosilicon composition and to the textiles obtained therefrom.

More specifically, the present invention relates to a method for providing durable press characteristics for cellulosic fiber-containing textiles by treating said textiles with a formaldehyde-free composition comprising methoxylated, phenyl-substituted organosilicon polymers.

Durable press textile finishes are commonly provided by treating the textile with prepolymers of urea-formaldehyde, melamine-formaldehyde, dimethylolethylene-urea, and a wide variety of other resin systems.

These resin prepolymers are dissolved in water to provide a treatment bath. The textiles are impregnated with the treatment bath solution, padded, i.e. squeezed to remove excess solution, and then either pressed as sheet fabric, thereby providing a fixed, crease-resistant surface, or formed into sewn articles, such as garments, and subsequently pressed.

Heat from the pressing operation is thought to cross-link the impregnating prepolymers to a hard resin.

Thus, areas of the fabric that are desired to stay flat and smooth are fixed to some degree through the cross-linking of the impregnating resin, and areas of the fabric that are desired to retain a crease are fixed, to some degree, by pressing in the crease.

Organosilicon polymers have been added to the resin solution treatment bath to provide improved hand, tear strength, and abrasion resistance, as taught by Rooks in U.S. Pat. No. 4,167,501. This method comprises the addition of an emulsion of a hydroxy-endblocked polydimethylsiloxane, along with crosslinkers, surfactants, and catalysts well known in the art.

However, these methods, which employ formaldehyde-based resins, are not completely satisfactory because formaldehyde-based resins can contain small amounts of free formaldehyde, or release small amounts of free formaldehyde as a byproduct during cure. Free formaldehyde is thought to constitute a health hazard. For this reason, formaldehyde-free textile treating compositions have been sought.

Worth, in U.S. Pat. No. 4,269,603, discussed the use of reactive silicone with formaldehyde-free glyoxal-based durable press treatment. In testing the reactive silicone by itself, however, he found it ineffective as a durable press treatment.

Another problem often encountered in textile treatment resins containing residual nitrogen compounds or groups is reaction with chlorine bleaching compounds, and consequent diminution of the fabric's strength.

Organosilicon polymers per se as durable press finishes have been the subject of investigation. Polyorganosiloxanediols are reported by Hosokawa et al. in U.S. Pat. No. 3,668,001 to give improved touch, i.e. hand, and crease resistance. These polymers are described by the inventors as being silicone rubber, and as having a relative viscosity in toluene at 25° C. of 1.8, a relative viscosity characteristic of a high polymer. A substantial degree of water resistance is imparted by these high polymers.

Deiner, in West German O.L.S. No. 2,922,376 discloses a method for preparing alkoxylation products of a polysiloxane containing silane, i.e. ≡SiH, groups. The alkoxylation is performed with alcohols having from 4 to 22 carbon atoms. The product of this alkoxylation is disclosed as an effective textile treatment. However, organosilicon compounds containing alkoxy radicals having more than 1 or 2,. and certainly more than 3 carbon atoms, are not as desirable from a cost and efficiency-of-cure aspect as are methoxy-containing organosilicon compounds.

BRIEF SUMMARY OF THE INVENTION

It is an object of the present invention to provide a method for imparting durable press characteristics to cellulosic fiber-containing textile fabrics. It is another object of this invention to provide a method of treating textiles with a formaldehyde-free durable press composition. It is another object of this invention to provide a method for producing textiles with good chlorine bleach resistance. It is a further object of this invention to provide a method for treating cellulosic fiber-containing textiles with relatively simple, inexpensive organosilicon compositions.

These and other objects, which will be apparent to those skilled in the art after considering the following disclosure and claims, are obtained by the discovery that certain methoxylated, phenyl-containing organosilicon copolymers provide the soft hand attainable with the use of polydimethylsiloxane, and further provide the durable press characteristics attainable with use of hard resinous products such as the formaldehyde-based resins.

This discovery was surprising in that the hard resinous products that provide good durable press characteristics impart a harsh hand. While polydimethylsiloxanes provide a soft hand, they are considered ineffective durable press finishes. Silicone rubber may give some durable press characteristics, but the resulting textile has a severely diminished absorbency.

The method of the present invention furnishes a nitrogen- and formaldehyde-free durable press treatment process by use of methoxylated, phenyl-containing organosilicon compounds. In addition, the method of the present invention provides the soft hand, which is desirable in many textiles, without using any additional polymeric components.

DETAILED DESCRIPTION OF THE INVENTION

The present invention relates to a method for imparting durable press characteristics to a cellulosic fiber-containing textile fabric, and to the textile fabric obtained therefrom, said method comprising (a) impregnating the textile fabric with a homogeneous composition comprising a volatile liquid carrier and a fluid organosilicon polymer selected from the group consisting of (i) polymers consisting of $(CH_3O)_xC_6H_5SiO_{(3-x)/2}$ units and $(CH_3O)_y(CH_3)_2SiO_{(2-y)/2}$ units wherein x has a value of 2, 1 or 0, y has a value of 1 or 0, the sum of x plus y has a value greater than 0, and the molar ratio of $(CH_3O)_xC_6H_5SiO_{(3-x)/2}$ units to $(CH_3O)_y(CH_3)_2SiO_{(2-y)/2}$ units has a value of from 1:4 to 1:40 and (ii) polymers consisting of $(CH_3O)_xC_6H_5SiO_{(3-x)/2}$ units, $(CH_3O)_zCH_3SiO_{(3-z)/2}$ units, and

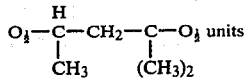

wherein x has a value of 2, 1 or 0, z has a value of 2, 1 or 0, the sum of x+z has a value greater than 0, the molar ratio of $(CH_3O)_xC_6H_5SiO_{(3-x)/2}$ units to $(CH_3O)_zCH_3SiO_{(3-z)/2}$ units has a value from 1:0.6 to 1:4, and the molar ratio of $(CH_3O)_xC_6H_5SiO_{(3-x/2)}$ units to

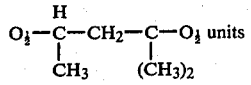

has a value of from 1:0.85 to 1:3.5 and (b) heating the impregnated textile fabric of (a) to crosslink the fluid organosilicon polymer.

The homogeneous composition used in the method of the present invention comprises a volatile liquid carrier and a fluid organosilicon polymer.

By volatile it is meant herein that the liquid carrier substantially completely evaporates from the impregnated textile fabric by the end of the heating step of the method of the present invention. Suitable volatile liquid carriers have boiling points at atmospheric pressure less than 200° C., preferably less than 175° C., and most preferably less than 150° C.

The volatile liquid carrier can be a solvent for the fluid organosilicon polymer, water, or combinations of solvent and water.

Examples of suitable solvents include aliphatic hydrocarbons, such as pentane, hexane, heptane, octane, nonane and the like; aromatic hydrocarbons such as benzene, toluene and xylene; alcohols such as methanol, ethanol, and butanol; ketones such as acetone, methylethyl ketone and isobutyl ketone; and halogenated solvents such as fluorine-, chlorine-, and bromine-substituted aliphatic or aromatic hydrocarbons, such as trichloroethane, perchloroethylene, bromobenzene and the like. Two or more solvents may be used together.

The volatile liquid carrier can be water when the fluid organosilicon polymer is emulsified. Use of a mechanical aqueous emulsion of the fluid organosilicon polymer is a preferred embodiment of the method of the present invention.

A volatile liquid carrier consisting of both solvent and water may be used wherein a solution of fluid organosilicon polymer is emulsified in water.

The fluid organosilicon polymers used in the present invention are clear to slightly hazy. The viscosity of the fluid organosilicon polymer is not critical, but is typically less than 5000 Pa.s and preferably less than 1000 Pa.s.

For fluid organosilicon polymers comprising $(CH_3O)_xC_6H_5SiO_{(3-x)/2}$ units and $(CH_3O)_y(CH_3)_2SiO_{(2-y)/2}$ units the molar ratio of said units has a value of from 1:4 to 1:40 and more preferably has a value of from 1:10 to 1:20.

For fluid organosilicon polymers comprising $(CH_3O)_xC_6H_5SiO_{(3-x)/2}$ units, $(CH_3O)_zCH_3SiO_{(3-z)/2}$ units and

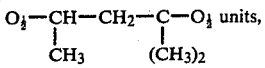

the molar ratio of $(CH_3O)_xC_6H_5SiO_{(3-x)/2}$ units to $(CH_3O)_zCH_3SiO_{(3-z)/2}$ units has a value of from 1:0.5 to 1:4, and preferably from about 1:1 to about 1:3; the molar ratio of $(CH_3O)_xC_6H_5SiO_{(3-x)/2}$ units to

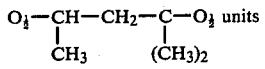

has a value from 1:0.85 to 1:3.5 and preferably from about 1:1 to about 1:2.5.

The fluid organosilicon polymers used in the present invention may be prepared by any of several known methods, such as the partial cohydrolysis and subsequent condensation of the appropriate alkoxysilanes with or without 2-methyl,2,4-pentanediol with an acidic or basic catalyst, or partial cohydrolysis and subsequent condensation of the appropriate chlorosilanes with or without 2-methyl,2,4-pentanediol. The best ways known at the present time to prepare the fluid organosilicon polymers used in the present invention are equilibration of the appropriate alkoxysilane with dimethylcyclosiloxanes in the presence of an acid such as sulfuric acid; and equilibration of the appropriate alkoxysilanes and 2-methyl,2,4-pentanediol in the presence of a base such as sodium methoxide.

These best known methods are described in U.S. Pat. No. 4,289,859 which is hereby incorporated herein by reference to teach further how to make the fluid organosilicon polymers of the method of this invention.

The molar ratio of said units of the fluid organosilicon polymers can be determined by any of a number of known methods, such as by decomposition and derivatization of the polymer of ethoxylated monomers followed by gas liquid chromatography of the derivatized product and comparison of the resultant chromatograph with known standards, infrared spectroscopic analysis of the polymer and comparison of the infrared spectrum with a known standard, or preferably they can be determined via nuclear magnetic resonance (n.m.r.) spectroscopy. Molar ratios of $CH_3Si\equiv$, $(CH_3)_2Si=$, $C_6H_5Si\equiv$, $CH_3OSi\equiv$, and

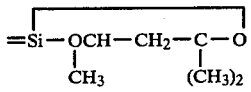

can be determined by n.m.r. spectroscopy from analysis of the n.m.r. spectrum by methods well known to the art.

The ratios can be recalculated to 1 mole of $C_6H_5Si\equiv$ on the basis of proportionality. For example, if the n.m.r. results are:

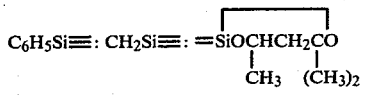

=1.62:1.0:1.39, the ratios are adjusted by dividing each number by the $C_6H_5Si\equiv$ value of 1.62, to give a $C_6H_5Si\equiv:CH_3Si\equiv$ ratio of 1:0.63 and a

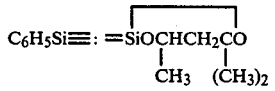

ratio of 1:0.86. This method is estimated to be subject to ±10% experimental error. Thus it is appropriate to round off to two significant figures.

To prepare the homogeneous composition used in the method of this invention, the fluid organosilicon polymer is either dissolved or emulsified in the volatile liquid carrier. The volatile liquid carrier lowers the viscosity of the homogeneous composition, and also serves as a means of controlling the amount of fluid organosilicon polymer deposited upon the textile fabric. The amount of fluid organosilicon polymer deposited upon the textile fabric is approximately proportional to the concentration of the fluid organosilicon polymer in the homogeneous composition.

Although other factors can effect the amount of fluid organosilicon polymer deposited on the textile fabric, such as absorbency of the textile fabric, viscosity and surface tension of the homogeneous composition, and temperature of impregnation, the amount deposited is most conveniently controlled by controlling the fluid organosilicon polymer concentration in the homogeneous composition.

Fluid organosilicon polymer concentrations in the homogeneous composition are not critical. Typical concentrations of polymer range from 0.1% to 10% by weight, preferably 0.5% to 5.0% by weight, and most preferably 1% to 2% by weight.

Homogeneous compositions comprising a solvent as the volatile liquid carrier are prepared by dissolving the fluid organosilicon polymer in the solvent.

The use of water as the volatile liquid carrier is preferred in the present invention.

An emulsion of the fluid organosilicon polymer in water can be made by thoroughly mixing the desired amount of fluid organosilicon polymer with the desired amount of water by mechanical dispersion means, such as imposing a high degree of shear upon said mixture or imposing a high frequency sonic field upon said mixture.

It is preferred that the emulsion of fluid organosilicon polymer in water be stabilized by including a surfactant.

The identity of the surfactant is not critical. The surfactant can be anionic, cationic, or nonionic.

Examples of suitable anionic surfactants include sulfonation products of saturated acids and their glycerides, sulfonation products of amides, phosphoric esters of the above-named groups, alkaryl sulfonates and the like.

Examples of suitable cationic surfactants include aliphatic amines, aromatic amines with aliphatic substituents, quaternary ammonium compounds, polyethylenediamine, polypropanolpolyethanolamines and the like.

Examples of suitable nonionic surfactants include condensation products of fatty substances with ethylene oxide, condensation products of phenolic compounds having aliphatic side chains with ethylene oxide and the like.

The surfactant, if used, can be added in an amount effective to improve the stability of the homogeneous composition to the degree desired. Typically 0.05% to 15% of surfactant is added to the homogeneous composition, or more preferably 0.2% to 2.0% of surfactant is added to the homogeneous composition.

Crosslinking aids, such as $CH_3Si(OCH_3)_3$, $CH_3Si(OCH_2CH_3)_3$, or $C_6H_5Si(OCH_3)_3$ can be added to the homogeneous composition to lower the time and/or temperature necessary to effect crosslinking during the heating step. From about 2% to about 10%, preferably about 4%, of an organotrialkoxysilane, as a weight percentage of the fluid organosilicon polymer, may be added. $CH_3Si(OCH_3)_3$ is the preferred organotrialkoxysilane.

Silanol and alkoxysilane condensation catalysts can be used to lower the time and/or temperature necessary to effect crosslinking during the heating step. Examples of such catalysts include amines such as trimethylamine, quaternary ammonium hydroxides such as tetramethyl ammonium hydroxide, and polydimethylsiloxane-soluble salts of Pb, Fe, Co, Zr, Ti, Sn, and Mn, such as their octoates, naphthenates and the like. Preferably organic compounds of Sn are added, such as stannous octoate, dibutyltindiisooctylmercaptoacetate, dibutyltindilaurate and the like.

The catalyst can be conveniently added in the form of an aqueous emulsion of a solution of the catalyst in a solvent such as a hydrocarbon solvent such as hexane, heptane, benzene, toluene, xylene and the like.

Catalyst concentration is not thought at this time to be critical, but it will be apparent to those skilled in the art that the catalyst should be added in an amount effective to lower the time and/or temperature of the heating step.

Non-essential components can be added to the homogeneous composition. Examples of such non-essential components include perfumes, colorants, dyes, brighteners, flammability control additives and the like. These components can be added to the homogeneous composition at any time so long as they do not destabilize the homogeneous composition or substantially inhibit the reactivity of the fluid organosilicon polymer deposited upon the textile fabric.

Textile fabrics upon which the method of the present invention may be advantageously employed include those containing from 10% to 100% cellulosic fibers. Cellulosic fibers are those derived from cellulose or containing cellulose chains, such as cotton, rayon and acetate fibers.

The cellulosic fibers can be blended with non-cellulosic fibers, such as the well-known polyester, polyacrylonitrile, or nylon fibers in either woven or non-woven fabrics.

Impregnation of the textile fabric with the homogeneous composition of the method of the present invention may be accomplished by spraying, such as with an aerosol, exposing a continuous web of the textile fabric to a continuous curtain of the homogeneous composition, or preferably by immersing the textile fabric in the homogeneous composition either continuously or in a batch operation.

It may be advantageous to squeeze the fabric free of excess homogeneous composition in an operation such as padding, wherein the fabric is pressed between rollers to remove excess liquid.

Pickup, i.e. the amount of homogeneous composition absorbed by the textile fabric may be measured gravimetrically, and is expressed as the weight percentage increase of the dry textile fabric. The pickup suitable for the practice of the method of the present invention will vary according to the thickness and absorbency of the textile fabric and the fluid organosilicon polymer content of the homogeneous composition. For example, with a very thick cotton fabric it might be desirable to have a pickup of 300 or 400% or more of homogeneous composition having a weight concentration of 1% fluid organosilicon polymer; or with a thin 15% cotton 85% polyester textile fabric a pickup of 50%, 25% or less of a homogeneous composition having 1% fluid organosilicon polymer may be sufficient.

After impregnation and padding, if a padding step is included, it may be convenient to include a drying step to facilitate handling of the impregnated textile fabric. The drying step can be conducted at temperatures from 20° C. to 150° C. for times of 10 seconds to several days, depending on the temperature. Thus at 150° C. a drying time of 10 seconds will be sufficient with many volatile liquid carriers, and at 20° C. 2 or 3 days might be necessary. In a preferred embodiment of this invention wherein the homogeneous composition comprises an aqueous emulsion, a drying time of 10 minutes at 100° C. is typical. Drying is optional and not critical, but if it is desired to subsequently press a crease or smooth area into the textile fabric, care should be taken to avoid crosslinking the fluid organosilicon polymer during the drying step. Crosslinking may be avoided in a drying step by holding the impregnated textile fabric at a given temperature within the above range for the minimum time necessary to substantially complete the evaporation of the volatile liquid carried.

Crosslinking of the fluid organosilicon polymer deposited upon the textile fabric is accomplished by heating said impregnated textile fabric. Temperatures from about 100° C. to about 280° C. for from 30 minutes to 5 seconds can accomplish crosslinking, wherein 30 minutes is an appropriate time at 100° C. and 5 seconds is an appropriate time at 280° C.

Combinations of time and temperature from 5 minutes at 150° C. to 10 seconds at 220° C. are preferred in the practice of this invention for most textile fabrics.

It will be apparent to those skilled in the textile treatment art that combinations of time and temperature that can be expected to degrade the textile fabric are to be avoided.

Crosslinking in the method of the present invention means to render the fluid organosilicon polymer substantially non-removable from the treated fabric when extracted with aqueous detergent solutions. Thus a textile fabric wherein the fluid organosilicon polymer is properly crosslinked will maintain substantially the same durable press characteristics through at least two subsequent home laundry cycles as recited in American Association of Textile and Colorant Chemists Standard 124-1975.

Crease resistance, i.e. durable press characteristics, is also evaluated as set forth in the above standard. A series of standarized fabric samples for comparison are furnished with ratings from 1 to 5. A value of 1 represents the creasing displayed by pure untreated cotton fabric, and 5 represents perfect crease resistance. The sample to be evaluated is matched with the standard it most nearly resembles with respect to number and severity of laundry cycle-induced creases. The sample is given the number corresponding to that standarized fabric which it most nearly resembles. An average of two or more independent results are obtained in this manner and the results are averaged.

The water absorbency of the textile fabric is evaluated by the water drop holdout test and the water absorbency test.

In the water drop holdout test, a single drop of water is placed upon the fabric and the time it takes to soak into the fabric is measured.

In the water absorbency test, the amount of water picked up by the fabric during water immersion is measured and expressed as a percentage of the dry weight of the textile fabric.

Stain release is evaluated by the stain release test. Textile fabrics are exposed independently to each of 5 test substances: 200 oil which is a highly viscous gear oil composition, mineral oil, vegetable oil, mustard, and butter. The soiled textile fabrics are laundered once, and rated from 1 to 5. A rating of 5 represents total disappearance of the stain and 1 represents no diminution of the stain. The rating for each substance is determined by at least two different observers, these ratings are averaged and then summed for the 5 substances. Thus a sum of 25 indicates ideal stain release and a sum of 5 indicates total lack of stain release.

In order that those skilled in the textile treating art may better understand the present invention, the following examples are presented. They are intended as illustrations and are not intended to limit the present invention. Parts and percentages are by weight except where otherwise indicated.

EXAMPLE 1

A. Preparation of a polymer consisting of $(CH_3O)_xC_6H_5SiO_{(3-x)/2}$ units and $(CH_3O)_y(CH_3)_2SiO_{(2-y)/2}$ units wherein x is 2, 1 or 0, y is 1 or 0 and x+y is greater than 0.

A quart bottle was charged with 777 g (10.5 equivalents) of dimethylcyclosiloxanes, 69 g (0.35 moles) of $CH_6H_5Si(OCH_3)_3$ and 5 drops of trifluoromethane sulfonic acid. After shaking to assure solution, the mixture was allowed to stand at room temperature for 48 hours. The resulting product was a clear fluid.

B. Preparation of an Emulsion from the above fluid organosilicon polymer 9 g of Tergitol TMN-6, a trimethylnonylpolyethylenepolyglycol ether sold by the Union Carbide Corporation of Danbury CT, 12.9 g of Triton X-405, an octylphenoxypolyethoxyethanol from Rohm and Haas of Philadelphia PA, and 188 g of water were placed together in a beaker, where they were mechanically stirred.

90 g of the fluid organosilicon polymer described above were added slowly to the above solution. The resulting mixture was passed twice through a homogenizer operating at a pressure of 6000 psi (41.5 MPa).

The homogenized emulsion was examined microscopically. Average particle size was found to be less than 1 $\mu$m, with 2% to 3% of the particles larger. A few were as large as 3 $\mu$m.

C. Treatment of a Textile Fabric

A homogeneous composition bath was prepared with 5.7 g of the emulsion prepared in step B, 0.5 g of $CH_3Si(OCH_3)_3$, 0.5 g of an aqueous emulsion of a toluene solution of dibutyltindiisooctylmercaptoacetate, and 193.3 g of distilled water.

A sample of a textile fabric comprising a blend of 65% polyester fibers and 35% cotton fibers was impregnated by immersion in the above homogeneous composition bath. After impregnation, the sample was padded at 10 psi (0.07 MPa). A weight pickup of 104% was measured gravimetrically.

The sample was then dried 10 minutes at 100° C., then cured for 30 seconds at 180° C. The fabric, after the above heating step, was found to have a soft, yet firm, hand. Further evaluation is listed in the table.

EXAMPLE 2

The procedure of Example 1 was repeated except that in step C the bath consisted of 5.7 g of the fluid siloxane polymer of Example 1 and 194.3 g of distilled water.

A fabric sample comprising a blend of 65% polyester fibers and 35% cotton fibers was impregnated by immersion in the bath of the present example and found to have a weight pickup of 103%. The sample was padded after immersion at 10 psi (0.07 MPa), dried 10 minutes at 100° C., then cured for 30 seconds at 180° C. The fabric, after the curing step above, was found to have a soft, yet firm, hand.

EXAMPLE 3

A. Preparation of a polymer consisting of $(CH_3O)_xC_6H_5SiO_{(3-x)/2}$ units, $(CH_3O)_zCH_3SiO_{(3-z)/2}$ units, and

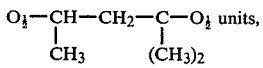

wherein x is 2, 1 or 0, y is 2, 1 or 0 and x+z is greater than 0.

A 1 liter, 1-necked flask fitted with a Dean-Stark reflux condenser assembly was charged with 248 g (1.25 moles) $C_6H_5Si(OCH_3)_3$, 102 g (0.75 moles) $CH_3Si(OCH_3)_3$, 148 g (1.25 moles) of 2-methyl-2,4-pentanediol, 31.5 g water, and a small quantity of sodium methoxide as a catalyst. Heat was applied up to 175° C. and volatile byproducts were collected. A few ml of acetic acid were added to the reaction mixture after it had cooled. The resulting fluid was vacuum stripped at 160° C. and a pressure of about 1 mm Hg (about 130 Pa). The fluid was filtered hot and was slightly viscous with a very slight haze.

Molar ratios of the constituent groups were found by nuclear magnetic resonance spectroscopy to be as follows:

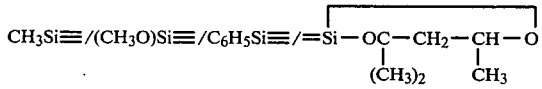

=1.0/0.12/1.6/1.4 These results indicate that the copolymerization of the pentanediol may have only been 90% complete.

This polymer was emulsified using the procedure of Example 1, a bath was prepared using this polymer in the formulation of Example 1, and samples of the 65/35 polyester/cotton blend textile fabrics were impregnated, padded, and heated according to the procedure of Example 1. Hand was found to be soft, yet firm. Further evaluation is listed in the table.

EXAMPLES 4 AND 5

Polymers were prepared via the method of Example 3 with the following molar ratios of starting materials:

Example 4:

$C_6H_5Si(OCH_3)_3$, 1.0 mole:

$CH_3Si(OCH_3)_3$, 3.0 moles:

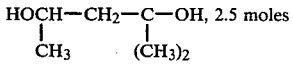

Example 5:

$C_6H_5Si(OCH_3)_3$, 1.0 mole:

$CH_3Si(OCH_3)_3$, 1.0 mole:

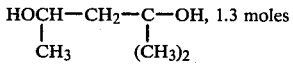

These polymers were used in the method of the present invention as in Example 1. Test results are summarized in the table.

EXAMPLES 6 AND 7

Polymers were prepared via the method of Example 1 with the following molar ratios of starting materials:

Example 6:

$C_6H_5Si(OCH_3)_3$, 1.0 mole:

dimethylcyclosiloxanes, 5.0 moles

Example 7:

$C_6H_5Si(OCH_3)_3$, 1.0 mole:

dimethylcyclosiloxanes, 15 moles

These polymers were used in the method of the present invention as in Eample 1. Test results are summarized in the table.

TABLE

Evaluation as Durable Press Treatment

| Measurement | Examples 1 | 3 | 4 | 5 | 6 | 7 | Control* |
|---|---|---|---|---|---|---|---|
| Durable Press Rating | | | | | | | |
| Initial | 3.9 | 3.45 | 4.0 | 3.5 | 3.7 | 3.7 | 3.0 |
| After six laundry cycles | 3.9 | 3.3 | 3.5 | 3.5 | 3.9 | 3.7 | — |
| Water Drop Holdout, sec. | 2 | 12.5 | 60 | 27 | 1.5 | 2 | 1 |
| Water Absorbence, wt % | 62 | 18 | 17 | 20 | 59 | 64 | 49 |
| Stain Release Rating | | | | | | | |
| After one wash | 13 | 15.8 | 11.5 | 13.5 | 13 | 15 | 15.4 |
| After two washes | 16.3 | 17.8 | 12.5 | 14.5 | 15.2 | 18.3 | 19.9 |

*A 65/35 polyester/cotton fabric processed like Example 1, except no fluid organosilicon polymer was present in the treatment bath. This is not an embodiment in the invention.

That which is claimed is:

1. A method for imparting durable press characteristics to a cellulosic fiber containing textile fabric, said method comprising:

(a) impregnating the textile fabric with a homogeneous composition comprising a volatile liquid carrier and a fluid organosilicon polymer selected from the group consisting of (i) polymers consisting of $(CH_3O)_xC_6H_5SiO_{(3-x)/2}$ units and $(CH_3O)_y(CH_3)_2SiO_{(2-y)/2}$ units wherein x has a value of 2, 1 or 0, y has a value of 1 or 0, the sum of x+y has a value greater than 0, and the molar ratio of $(CH_3O)_xC_6H_5SiO_{(3-x)/2}$ units to $(CH_3O)_y(CH_3)_2SiO_{(2-y)/2}$ units has a value of from 1:4 to 1:40 and (ii) polymers consisting of $(CH_3O)_xC_6H_5SiO_{(3-x)/2}$ units, $(CH_3O)_zCH_3SiO_{(3-z)/2}$ units, and

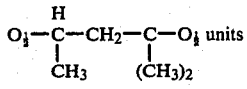

wherein x has a value of 2, 1 or 0, z has a value of 2, 1 or 0, the sum of x+z has a value greater than 0, the molar ratio of $(CH_3O)_xC_6H_5SiO_{(3-x)/2}$ units to $(CH_3O)_zCH_3SiO_{(3-z)/2}$ units has a value from 1:0.5 to 1:4, and the molar ratio of $(CH_3O)_xC_6H_5SiO_{(3-x)/2}$ units to

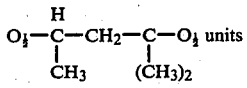

has a value of from 1:0.85 to 1:3.5; and (b) heating the impregnated textile fabric of (a) to crosslink the fluid organosilicon polymer.

2. The method of claim 1 wherein the fluid organosilicon polymer consists of $(CH_3O)_xC_6H_5SiO_{(3-x)/2}$ units and $(CH_3O)_y(CH_3)_2SiO_{(2-y/2}$ units.

3. The method of claim 1 wherein the fluid organosilicon polymer consists of $(CH_3O)_xC_6H_5SiO_{(3-x)/2}$ units, $(CH_3O)_zCH_3SiO_{(3-z)/2}$ units and

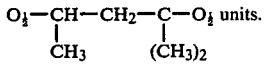

4. The method of claim 1, 2 or 3 wherein the homogeneous composition is an emulsion and the volatile liquid carrier is water.

5. The method of claim 1, 2 or 3 wherein the homogeneous composition further comprises an amount of a silanol condensation catalyst effective to cure the fluid organosilicon polymer.

6. The method of claim 5 wherein the silanol condensation catalyst is an organic compound of tin.

7. The method of claim 1, 2 or 3 wherein the homogeneous composition further comprises from about 2% to about 10% based on the weight of the fluid organosilicon polymer of $(CH_3O)_3SiCH_3$.

8. A durable press textile fabric produced by the method of claim 1, 2 or 3.

9. A durable press textile fabric produced by the method of claim 5.

10. A durable press textile fabric produced by the method of claim 7.

* * * * *